US009707763B2

(12) United States Patent
Nakagawa et al.

(10) Patent No.: US 9,707,763 B2
(45) Date of Patent: Jul. 18, 2017

(54) PRINTING APPARATUS AND MIST COLLECTION METHOD

(71) Applicant: CANON KABUSHIKI KAISHA, Tokyo (JP)

(72) Inventors: Yoshinori Nakagawa, Kawasaki (JP); Masaya Uetsuki, Yokohama (JP); Toshimitsu Danzuka, Tokyo (JP); Kazuo Suzuki, Yokohama (JP); Masataka Kato, Yokohama (JP); Tsuyoshi Ibe, Yokohama (JP); Shin Genta, Yokohama (JP); Tomoki Yamamuro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/040,153

(22) Filed: Feb. 10, 2016

(65) Prior Publication Data

US 2016/0243834 A1 Aug. 25, 2016

(30) Foreign Application Priority Data

Feb. 20, 2015 (JP) ..... 2015-031662

(51) Int. Cl.

| | |
|---|---|
| ***B41J 2/17*** | (2006.01) |
| ***B41J 11/00*** | (2006.01) |
| ***B41J 2/165*** | (2006.01) |
| ***B41J 29/17*** | (2006.01) |

(52) U.S. Cl.

CPC ..... *B41J 2/1714* (2013.01); *B41J 2/16517* (2013.01); *B41J 2/16526* (2013.01); *B41J 2/1721* (2013.01); *B41J 11/0065* (2013.01); *B41J 11/0085* (2013.01); *B41J 29/17* (2013.01); *B41J 2/165* (2013.01); *B41J 2002/1742* (2013.01)

(58) Field of Classification Search

CPC ..... B41J 2/1714

See application file for complete search history.

(56) References Cited

U.S. PATENT DOCUMENTS

| | | | | |
|---|---|---|---|---|
| 6,447,095 | B1 | 9/2002 | Kanda et al. | |
| 8,882,232 | B2 | 11/2014 | Ibe et al. | |
| 2006/0197983 | A1* | 9/2006 | Hatanaka | B41J 2/2107 358/1.18 |
| 2008/0111851 | A1* | 5/2008 | Muhl | B41J 2/1714 347/30 |
| 2009/0091593 | A1* | 4/2009 | Sakurai | B41J 2/1721 347/9 |
| 2011/0025738 | A1* | 2/2011 | Rosati | B41J 11/0085 347/9 |
| 2014/0333699 | A1* | 11/2014 | O'Hara | B41J 11/0085 347/34 |

FOREIGN PATENT DOCUMENTS

| | | |
|---|---|---|
| JP | 02-179761 A | 7/1990 |

* cited by examiner

*Primary Examiner* — Shelby Fidler

(74) *Attorney, Agent, or Firm* — Fitzpatrick, Cella, Harper & Scinto

(57) ABSTRACT

A printing apparatus performs a printing operation where mist that is generated in inkjet printing is efficiently collected. Specifically, a fan is rotated during a mist collection operation at a maintenance operation with a rotating speed that is greater than the rotating speed of the fan during printing.

6 Claims, 9 Drawing Sheets

PRINTING APPARATUS AND MIST COLLECTION METHOD

BACKGROUND OF THE INVENTION

Field of the Invention

The present invention relates to a technique for collecting ink mist in an inkjet printing.

Description of the Related Art

In printing of an inkjet method, ink mist is generated in association with an ink ejection operation of a print head. In some cases the mist adheres to a conveyance passage of a sheet to contaminate the sheet to be conveyed thereon or adheres to various sensors to cause erroneous detections. For addressing the above problems, Japanese Patent Laid-Open No. H02-179761(1990) describes a technique that a suction fan is used to suction and collect the mist.

In Japanese Patent Laid-Open No. H02-179761(1990),an intensity of the suction is set to the extent of not affecting a landing position of ink ejected from a print head, that is, a print quality at the printing time. As the suction gets stronger, collection efficiency of the mist improves, but in consideration of the print quality degradation, the suction intensity is suppressed on purpose.

In the inkjet printing, a preliminary ejection is performed for maintenance of the print head in addition to the print operation. Since inks are ejected from all the nozzles in the preliminary ejection, more mist tends to be generated than at the printing time. However, in Japanese Patent Laid-Open No. H02-179761(1990), no consideration is given on how to suction mist generated at the time other than at the print operation.

SUMMARY OF THE INVENTION

An object of the present invention is to provide a printing apparatus and a mist collection method that make it possible to more efficiently collect mist generated in inkjet printing.

In a first aspect of the present invention, there is provided a printing apparatus performing printing by using a print head for ejecting ink, the printing apparatus comprising: a collection unit configured to collect mist generated from the print head; and a control unit configured to control a collection power of the collection unit in ink ejection from the print head at a maintenance operation different from a printing operation to be made greater than the collection power in the printing operation in which ink is ejected to a sheet from the print head.

In a second aspect of the present invention, there is provided a mist collection method of collecting mist generated form a print head for ejecting ink, the mist collection method comprising: a first step of collecting the mist generated in ink ejection to a sheet from the print head; and a second step of collecting the mist generated in ink ejection to a portion other than the sheet from the print head, wherein the second step performs the collection of mist with greater collection power than the first step.

According to the present invention, at the printing time it is possible to perform the mist collection to the extent of not affecting the print result, and at the maintenance operation time it is possible to perform more efficiently the mist collection. As a result, it is possible to more efficiently collect the mist generated in the inkjet printing.

Further features of the present invention will become apparent from the following description of exemplary embodiments (with reference to the attached drawings).

DESCRIPTION OF THE EMBODIMENTS (First Embodiment)

Figure 1:
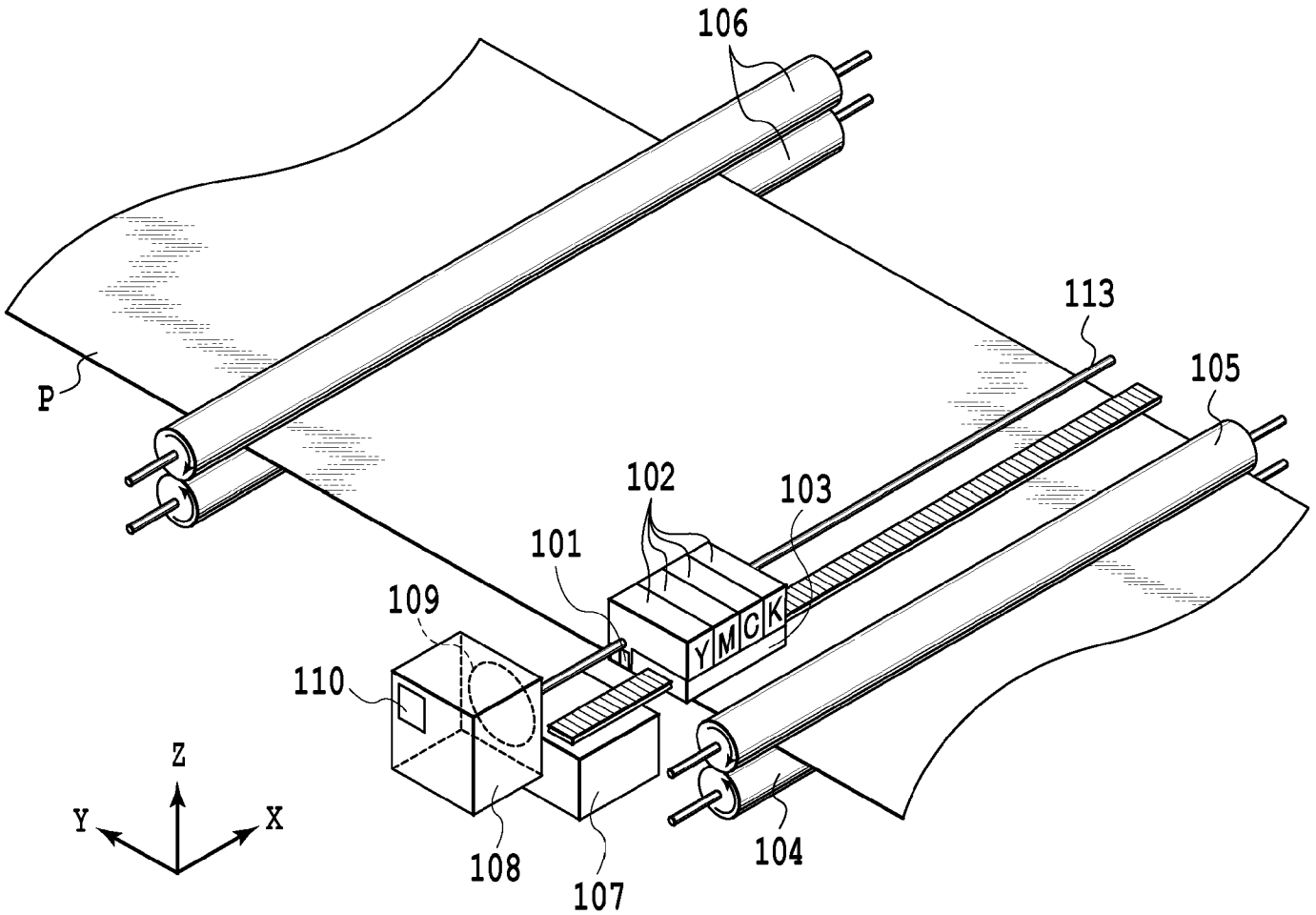
FIG. 1 is a perspective view illustrating the schematic configuration of an inkjet printing apparatus according to an embodiment of the present invention, mainly a print part thereof.

FIG. 1 is a perspective view illustrating the schematic configuration of an inkjet printing apparatus according to an embodiment of the present invention, mainly a print part thereof. A print head 101 is mounted on a carriage 103. The print head 101 is provided with head chips for ejecting inks of black (K), cyan (C), magenta (M) and yellow (Y) respectively. The inks of the four colors are supplied to the associated head chips from four ink tanks 102 that accommodate therein the inks respectively. The respective ink tanks 102 are structured in such a manner as to be capable of being replaced individually, each holding the ink by a negative pressure generating mechanism disposed inside the ink tank 102. The carriage 103 can reciprocate in main scan directions (an X direction and a direction opposing the X direction in the figure) by a not shown drive motor while being guided by a carriage shaft 113. The print head 101 scans a sheet P (print medium) through the movement of the carriage 103 in the main scan direction and ejects ink to the sheet during the scanning, thereby completing printing on the sheet by the amount corresponding to the width of one scan. When the print is completed by the amount corresponding to the width of one scan, the sheet P held between a conveyance roller 104 and a pinch roller 105 is conveyed in the Y direction in the figure with rotation of the conveyance roller 104 by a drive motor. In this conveyance, the sheet P is held between sheet discharge rollers 106 paired at the downstream side in the conveyance direction and generates tension between a holding part of the sheet discharge rollers 106 and a holding part of the conveyance rollers 104. The printing in accordance with the one scan by the print head 101 as described above and the sheet conveyance of the amount corresponding to the print in accordance with the one scan are repeated to complete the printing in accordance with one page.

A maintenance unit 107 is provided outside of a print area within the movement range of the carriage 103. The maintenance unit 107 is provided with a capping mechanism, a wiping mechanism, and a suction mechanism, and performs the maintenance as needed in such a manner as to be capable of maintaining the ejection performance of the print head 101. The wiping mechanism wipes an ejection opening face of the print head to remove ink droplets and water droplets attached on the ejection opening face. In addition, the suction mechanism suctions ink through ejection openings (nozzles) of the print head to remove the thickened ink in the ejection openings. Further, the print head 101 can perform a preliminary ejection in which the print head ejects inks to a preliminary ejection receiver in the maintenance unit 107. This preliminary ejection allows the thickened ink inside the ejection opening to be discharged and the mixed color ink of the respective color inks that is possibly generated by the wiping or the like to be removed. On the other hand, a mist collection mechanism 108 is provided further outside of the maintenance unit 107 to the print area. The mist collection mechanism 108 takes in the mist generated in the print area or in the maintenance unit together with air through a suction hole 109 with rotation of a fan (not shown) and discharges the air through a discharge hole 110. As a result, the mist existing in the print area and the like can be collected.

Figure 2:
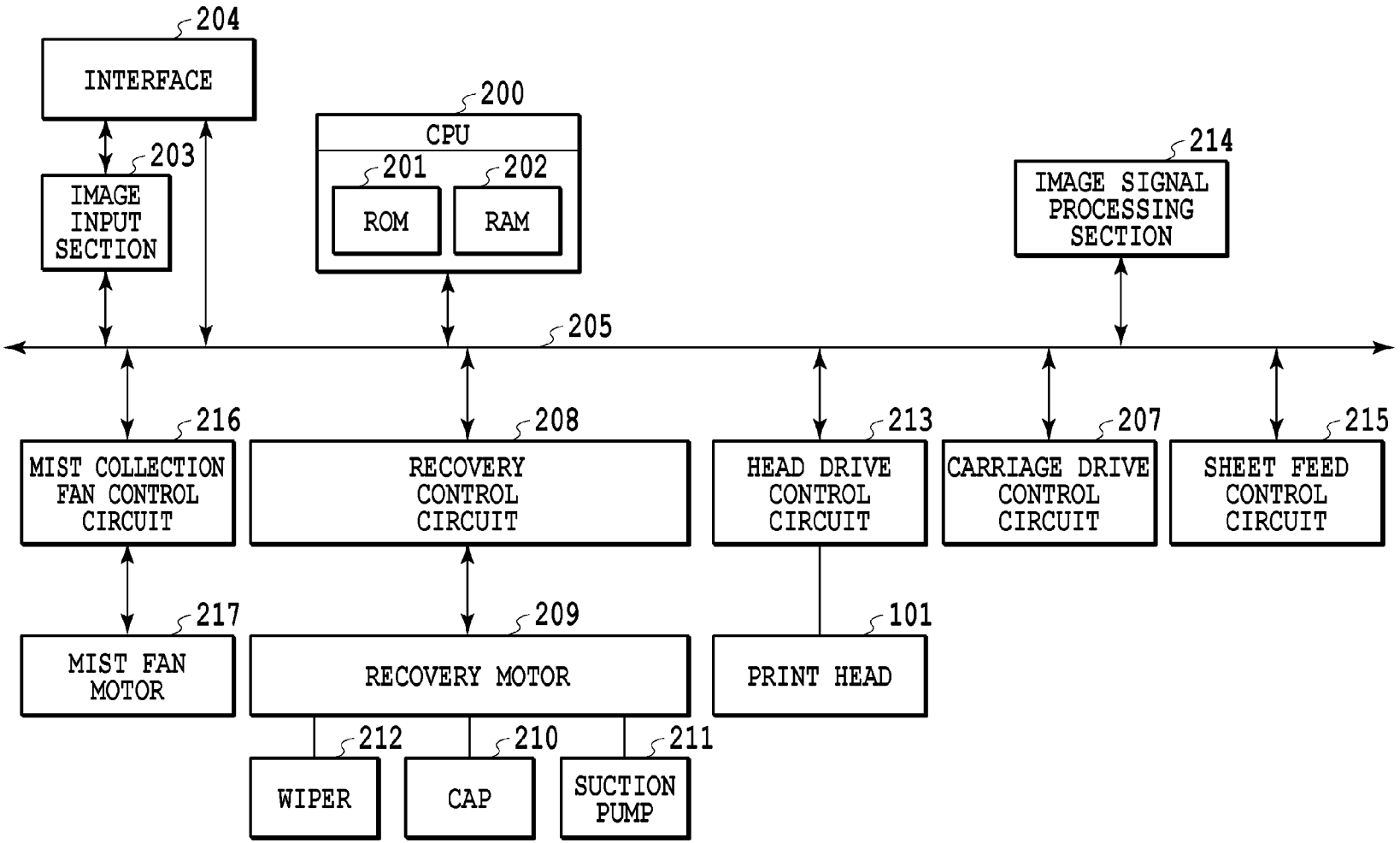
FIG. 2 is a block diagram illustrating the control configuration of the inkjet printing apparatus illustrated in FIG. 1.

FIG. 2 is a block diagram illustrating the control configuration of the inkjet printing apparatus illustrated in FIG. 1. A CPU 200 executes control and data processing for each section through a main bus line 205. More specifically, the CPU 200 controls the data processing, a print head drive and a carriage drive through each of the following sections according to programs stored in the a ROM 201 to control a print operation. In addition, the CPU 200 can execute the communication processing with a host apparatus through an interface 204. A RAM 202 is used as a work area of the data processing and the like by the CPU 200, and can temporarily store print data corresponding to plural scans, parameters relating to a recovery processing operation and a supply operation in the inkjet printing apparatus, and the like. An image input section 203 temporarily retains an image data input from the host apparatus through the interface 204 with the host apparatus. A recovery control circuit 208 performs a drive control of a recovery motor 209 according to a recovery processing program stored in the RAM 202 to control an up-down operation of a cap 210, an operation of a wiper 212 and a recovery operation by a suction pump 211. A head drive control circuit 213 controls driving of the print head 101 for the ink ejection to cause the print head 101 to perform the preliminary ejection and the ink ejection for printing. A carriage drive circuit 207 performs controlling of the scan of the print head 101 in the main scan direction according to the print data processed in an image signal processing section 214 and controlling of the movement of the print head 101 to the maintenance unit 107 for executing the recovery processing of the print head 101. A sheet feed control circuit 215 causes a sheet to move in the sub scan direction according to print data for printing the print data associated with the next scan after completion of the scan of the print head for printing.

A mist collection fan control circuit 216, as described later in FIGS. 5A and 5B, and the like, controls a drive of a mist collection fan motor 217. Specifically the mist collection fan control circuit 216 controls the drive of the mist collection fan motor 217, based upon information from the CPU 200 on whether the printing apparatus is in the middle of a print operation or a maintenance operation including a preliminary ejection operation.

Figure 3A:
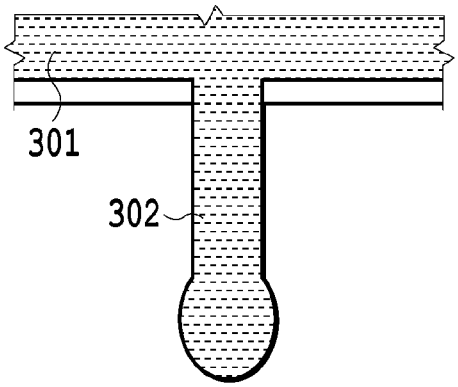
FIGS. 3A to 3C are diagrams illustrating a generation mechanism of mist following the ink ejection from a print head.
Figure 3B:
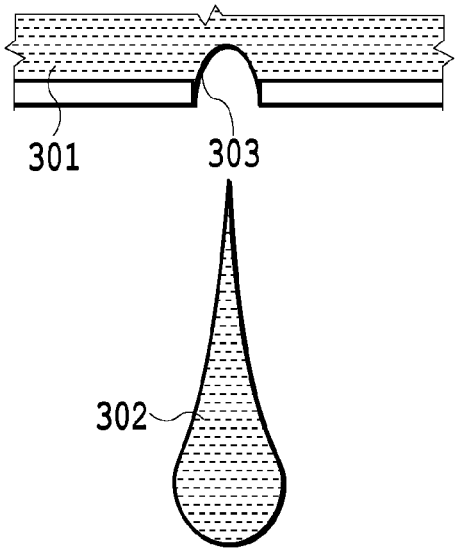
Figure 3C:
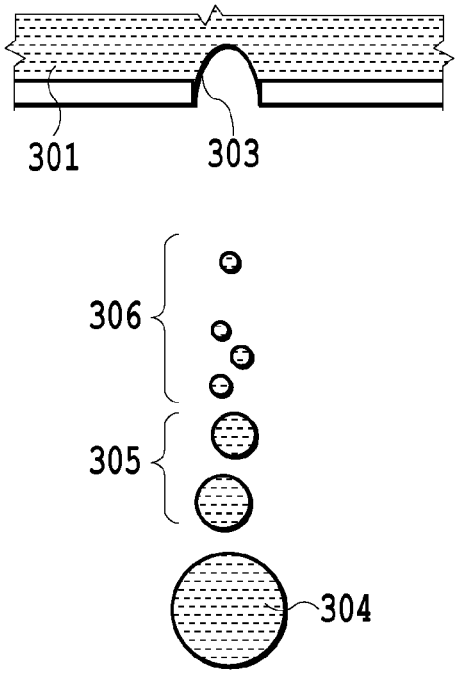

FIGS. 3A to 3C are diagrams explaining the generation mechanism of mist following the ink ejection from the print head as an example of the mist, each illustrating a cross section of ink and the vicinity of the ejection opening of the print head as viewed from a direction vertical to the ink ejection direction. In each of FIGS. 3A to 3C, indicated at 301 is ink, indicated at 302 is ink immediately after the ejection, indicated at 303 is a meniscus, indicated at 304 is a main droplet, indicated at 305 are satellite droplets, and indicated at 306 is mist.

As illustrated in FIG. 3A, the ejection of ink starts from the ejection opening of the print head. Immediately after the ejection starts, the ink ejected from the ejection opening is formed as a columnar ink 302. After that, as illustrated in FIG. 3B, when the drive for the ejection is completed, the meniscus 303 retreats. That is, the ink 301 moves into an inside of the print head by a negative pressure in the ink tank side. Then, when the retreated ink and the ejected ink are separated, a speed distribution is generated in the ejected ink column by surface tension of the ink. Thus, as illustrated in FIG. 3C, the ink under the speed distribution is divided to be composed of an ink droplet (main droplet 304) having the largest volume and the fastest speed, ink droplets (satellite droplets 305) each having a volume and a speed both smaller than those of the main droplet, and ink mist 306 each having a volume and a speed both smaller than those of the satellite droplet. The ink mist 306 loses speed in the ejection direction in the middle of the flying, and finally floats in the apparatus. In the mist generating mechanism as described above, in a case where the landing position of ink is close to the ejection opening position, because mist adheres to the landing position on the print sheet, the amount of the mist floating in the printing apparatus is small, and in a case where the landing position of ink is far from the ejection opening position, the amount of the mist floating is larger than the above case.

Figure 4:
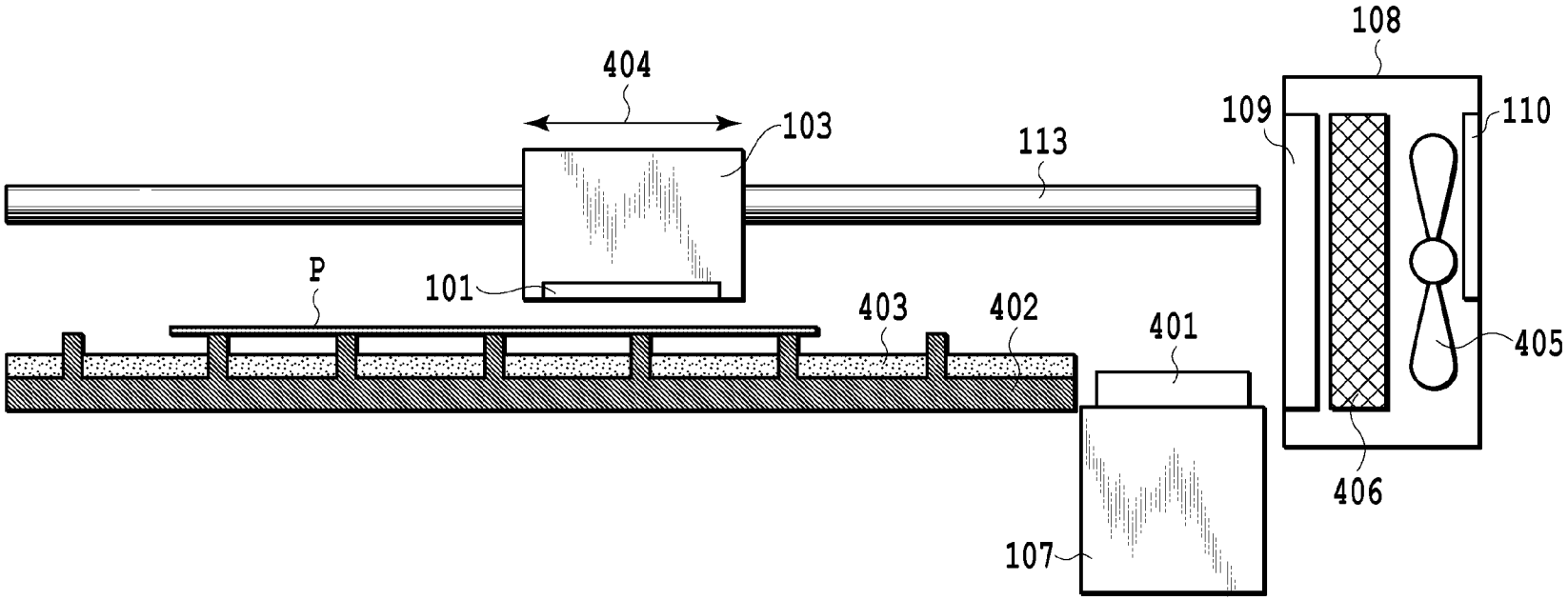
FIG. 4 is a diagram explaining an inkjet printing apparatus according to a first embodiment of the present invention, particularly a collection mechanism of mist therein.

FIG. 4 is a diagram explaining a mist collection mechanism and schematically illustrates an x-z section of the collection mechanism and the like. During the printing operation, ink mist is generated from the print head 101 in association with the printing operation. In the following description, this generated mist is called "print-operation mist". When a fan 405 in the mist collection mechanism 108 is rotated during the printing operation, the air containing the print-operation mist in the inkjet printing apparatus is taken in the mist collection mechanism 108 through the suction hole 109, and is separated into ink mist and air in a mist collection unit 406. As the mist collection unit 406, a filter or the like that can be formed of a porous body or fiber is used, but the mist collection unit may be made of the form of separating the mist using centrifugal separation. The air in which the mist is separated and removed is discharged outside of the mist collection mechanism 108 through the discharge hole 110.

When the fan 405 is operated, the flow of the air is generated in association with the mist collection, in the inkjet printing apparatus. The flow of the air is also generated between the print head and the sheet P, and the landing position of an ejected ink droplet is possibly shifted depending on a flow amount of the air to degrade the quality of a printed image. Therefore the rotating amount of the fan 405 per unit time (rotating speed; mist collection power or ability) is controlled to a constant amount or less during the printing operation. Thereby a flow amount of air current (volume of air flowing per unit time) is defied at the amount to the extent that the landing position of the ejected ink droplet is not shifted.

On the other hand, the ink mist can be generated mainly at the preliminary ejection operation time as well in the maintenance operation accompanied by the ejection from the print head 101, other than the print-operation mist. In the following description, this generated mist is called "preliminary-ejection mist". An example of timing when the preliminary ejection mist is generated will be explained hereinafter.

As described above, the maintenance unit 107 is provided with a preliminary ejection receiver 401. In the suction recovery operation of the print head as one of the maintenance operations, in some cases an ink of the other color is mixed in the ejection opening of the print head to generate the mixed color ink. Therefore the preliminary ejection is performed to the preliminary ejection receiver 401 and the mixed color ink is discharged from the ejection opening. The preliminary ejection receiver 401 is placed in a position spaced by a necessary distance from the print head 101 for avoiding contact between the ejected and stayed ink and the print head 101. At this time, the distance between the print head 101 and the preliminary ejection receiver 401 is larger than a distance between the print head 101 and the sheet P. As a result, even in a case where the same number of times of the ejections is performed, the amount of the preliminary ejection mist become larger than that of the printing-by mist.

The ejection (dissolving operation) for dissolving ink deposits as the maintenance operation is performed in addition to the aforementioned ejection operation. The printing apparatus of the present embodiment can execute a so-called margin-less printing. In the margin-less printing, the printing apparatus prints an image larger than a size of the sheet P, for which ink is ejected out of the sheet P in the scan by the print head. Then the ink ejected over the sheet P lands on platen absorption bodies 403 provided in a platen 402 for supporting the sheet P to be absorbed therein. However, the ink absorbed in the absorption body is thickened in viscosity in association with vaporization of water components for fixation. Then, the thickened and fixed inks are accumulated, and as a result, when the inks are deposited on the platen absorption body 403, in some cases the deposited ink comes in contact with the backside of the sheet P to cause the sheet P to be contaminated. Therefore, the process of ejecting ink that can dissolve the deposit is executed.

The dissolving operation is performed in such a manner as to eject inks of all the colors or at least one color on the platen absorption body 403 each time the margin-less printing is performed or each time the margin-less printings are performed a predetermined number of times. It should be noted that a head that ejects liquids for the dissolving ink deposition may be provided separately in addition to the print head for inks of K, C, M and Y. In this dissolving operation, the amount of inks larger than the preliminary ejection operation is ejected toward the platen absorption body. In addition, a distance from a nozzle to the platen absorption body is longer than a distance from a regular nozzle to the sheet. Therefore a generated amount of mist becomes very large. That is, the generated amount of the mist at the dissolving operation time becomes larger than that at the print operation time and further, at the preliminary ejection time. The collection operation by the mist collection mechanism is performed for the collection of mist generated in the dissolving operation as well.

The collection for mist generated at the time of the maintenance operation such as the preliminary ejection operation or the dissolving operation as described above is different from the collection of the printing-operation mist, and does not require the consideration of harmful effects to the print by the fan operation. Therefore the suction amount of mist by the fan (mist collection power) is made larger, thus making it possible to efficiently collect the mist.

Figure 5A:
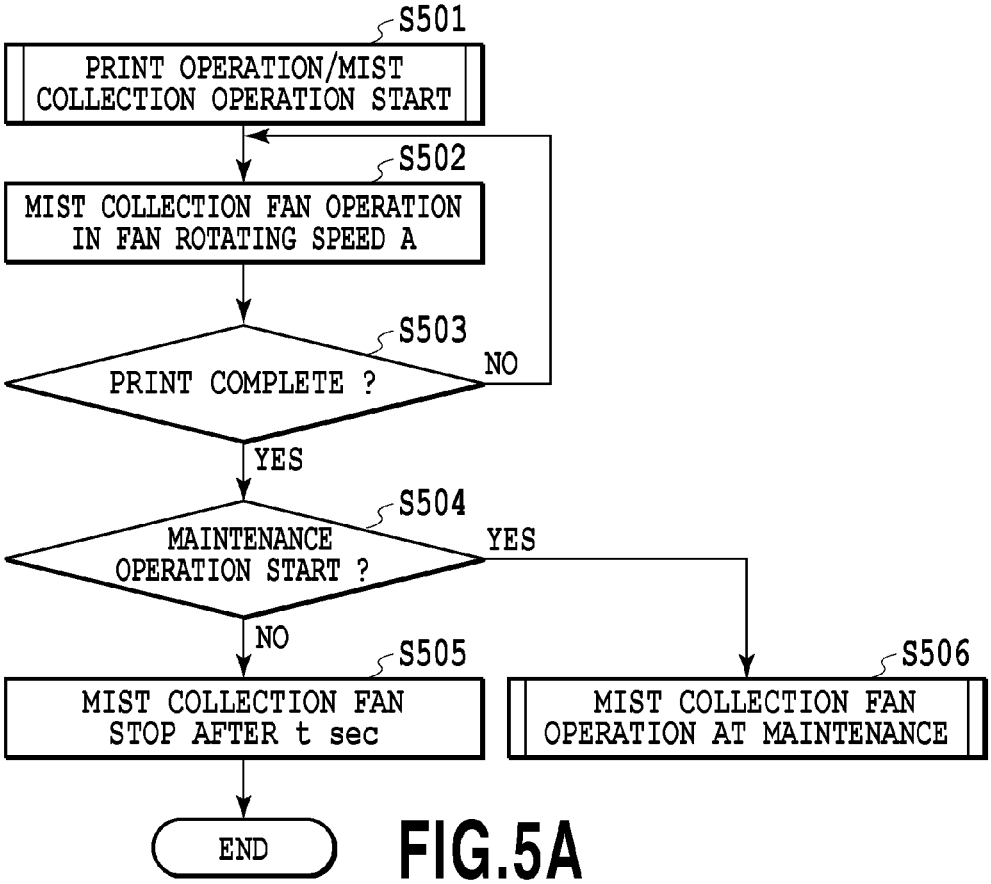
FIGS. 5A and 5B are flow charts each illustrating a mist collection operation according to the first embodiment.

FIG. 5A is a flow chart illustrating the mist collection operation. At step 501, the print operation is started, and the mist collection operation at the printing time is started. In this mist collection operation, first at step 502 a rotation number of the fan 405 (number of rotations per unit time, hereinafter called simply "rotating speed" as well) is set to "A" and rotate the fan 405. This rotating speed A is set to a rotating speed in which the flow amount of air current generated by rotating the fan with this rotating speed does not affect a track of the ejected ink. The mist collection operation is continuously performed during the printing operation, and when at step 503 it is determined that the printing operation is completed, the process goes to step 504. In a case where the print operation continues to be performed, the mist collection operation at step 502 continues to be performed.

At step 504 it is determined whether or not the maintenance operation such as the suction recovery operation, the dissolving processing of ink deposits, and the like following the print completion is being performed. When it is determined that the maintenance operation is not being performed, at step 505 after t seconds elapse after the above determination is made, the fan 405 is stopped to finish the mist collection operation at the printing operation. It should be noted that the time t seconds to the mist collection fan stop is preliminarily set as a time in which the mist in the present printing apparatus is reduced to be sufficiently small. Further, the rotating speed of the mist collection fan 406 during t seconds after the print completion may be set larger than the rotating speed A at the printing time. For example, it may be set as a rotating speed of the mist collection fan that is set in the mist collection operation at the maintenance operation that will be described next. As a result, a more efficient mist collection can be performed to make the time to the stop shorter.

When at step 504 it is determined that the maintenance operation starts to be performed following the print completion, the mist collection operation at the maintenance is performed.

Figure 5B:
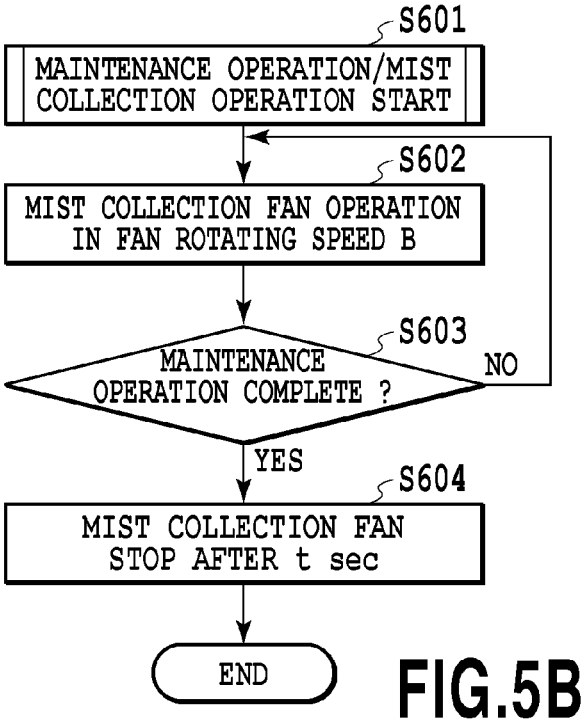

FIG. 5B is a flow chart illustrating the mist collection operation at the maintenance operation. At step 601, the maintenance operation by the preliminary ejection in the suction recovery operation or by the ink ejection for dissolving ink deposits is started, and the mist collection operation at the maintenance operation is started. In this mist collection operation, first at step 602 the rotating speed of the fan 405 is set to "B" and the fan 405 is rotated. The rotating speed B of the fan 405 for the mist collection operation at the maintenance operation is a value larger than the rotating speed A. The flow amount of air current to be collected can be increased by rotating the fan with this rotating speed to more efficiently perform the mist collection. Further, even if the rotation speed of the fan at the maintenance operation is set to a value larger than the rotating speed at the printing operation time, since the print operation is not performed simultaneously, this setting does not lead to degradation of the print quality.

Next, at step 603 it is determined whether or not the maintenance operation is completed. When it is determined that the maintenance operation is completed, the process goes to step 604, and when it is determined that the maintenance operation is not completed, the mist collection operation continues to be performed. When it is determined that the maintenance operation is completed, at step 604 the mist collection operation is finished after t seconds which is preliminarily set as a time in which the mist in the printing apparatus is reduced to be sufficiently small. The maintenance operation is performed as illustrated in FIG. 5B depending upon which maintenance operation of the preliminary ejection operation and the dissolving operation the maintenance operation determined to be started at step 504 after the completion of the print operation corresponds to. In the above description, the explanation is made of an embodiment in which the mist collection operation starts during the printing operation and the maintenance operation, but even when the mist collection operation is started ahead of them, the same effect can be obtained.

As described above, according to the present embodiment, at the printing time of ejecting ink on the sheet, the mist collection operation in which the rotating speed of the mist collection fan is small is performed for avoidance of degradation in print quality. On the other hand, at the maintenance by the preliminary ejection operation for performing the ink ejection other than the sheet, the mist collection operation in which the rotating speed of the mist collection fan is larger than that at the printing time is performed. That is, the collection power by the collection mechanism is controlled to be made greater at the maintenance of ejecting ink other than the sheet from the print head than at the print operation time of ejecting ink from the print head to the sheet. With this control, the more efficient mist collection operation is made possible at the maintenance in which many mist are generated. As described above, the generated amount of the mist at the dissolving time is very large and is larger than at the print operation time and at the preliminary ejection time. Therefore it is very effective to intensify the collection power of the mist at the dissolving operation time.

(Second Embodiment)

A second embodiment of the present invention relates to an embodiment of using a suction platen mechanism for suctioning and holding a sheet to a platen, as a mist collection mechanism, and uses the mist collection mechanism to perform a collection operation of mist generated by the dissolving operation of ink deposits deposited on the platen.

Figure 6:
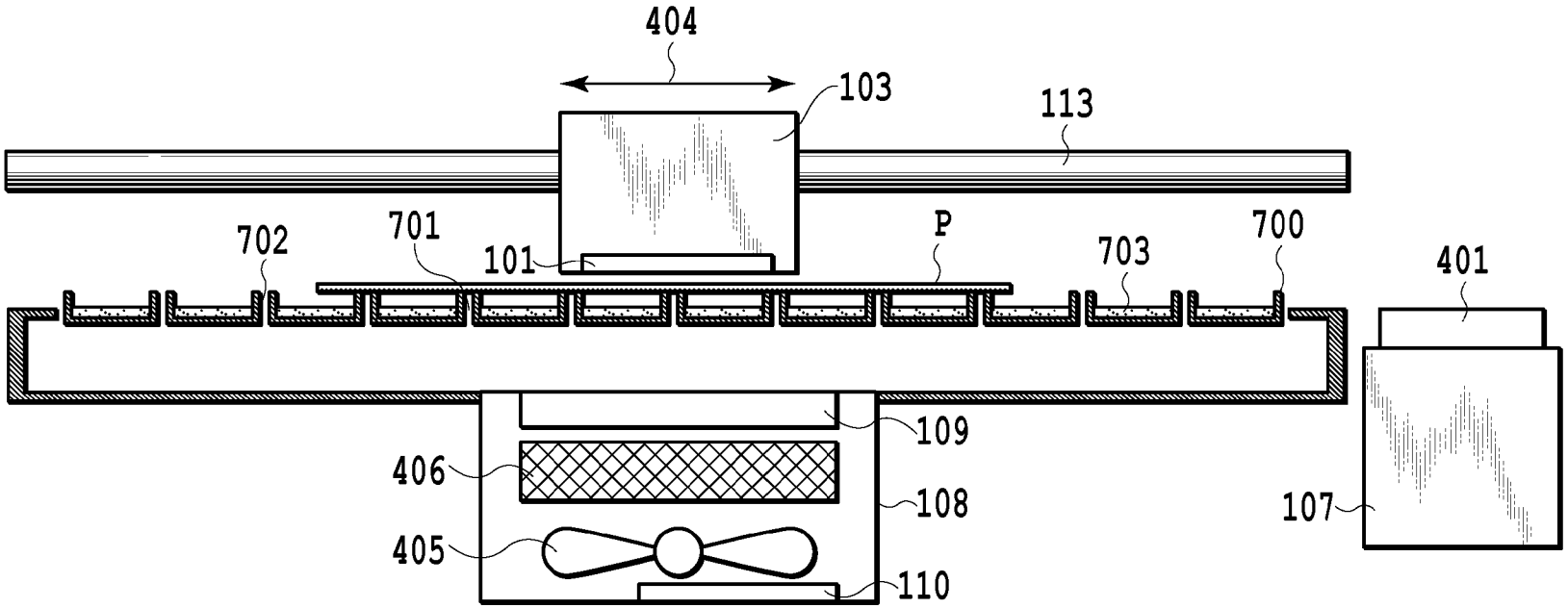
FIG. 6 is diagram explaining an inkjet printing apparatus according to a second embodiment of the present invention, particularly a collection mechanism of mist therein.

FIG. 6 is a diagram explaining an inkjet printing apparatus according to the second embodiment, particularly a mist collection mechanism therein and illustrates the structure in cross section. In FIG. 6, components identical to those illustrated in FIG. 4 and the like according to the first embodiment are referred to as identical reference signs and the explanation is omitted.

As illustrated in FIG. 6, a platen 700 is provided with a plurality of platen suction holes 701, and the suction holes 701 are communicated with a mist collection mechanism 108 disposed under the platen. Rotation of a fan 405 in the mist collection mechanism 108 creates a negative pressure in the platen suction holes 701, and a sheet P conveyed on the platen in the middle of printing is urged to the platen 700 with this negative pressure. Thereby, in a case where the sheet is deflected, the sheet is flattened and a print face of the sheet is flattened, further making it possible to prevent irregularities of the sheet by the deflection of the sheet from being in friction with the print head 101. On the other hand, suction holes 702, on upper parts of which the sheet P does not exist, exist on both sides of the sheet P (or on one side thereof depending upon a sheet size) in a min scanning direction. These suction holes 702 can suction the mist in the present printing apparatus by the negative pressure generated with rotation of the fan 405.

In addition, in a case of performing a margin-less printing, the ink ejected out of the sheet lands on the platen absorption bodies 703 arranged in the platen. Depending upon the ink, the ink is thickened in viscosity with evaporation after being absorbed in the platen absorption body to be ink deposits on the platen absorption body. There are some cases where the development of the ink deposits causes the sheet backside to be contaminated. Therefore the dissolving operation for ejecting the ink having characteristics of dissolving deposits to the ink deposits with use of the print head is performed as the maintenance operation.

The mist collection mechanism 108 performs the collection of mist that are possibly generated by the dissolving operation for the deposits. In this example, since a distance between the platen absorption body as a mist generating area and the suction hole is short, the collection efficiency can be made higher than the form of having the mist collection hole outside of the print area as in the aforementioned first embodiment.

The mist collection operation in the printing operation and the mist collection operation in the dissolving operation of deposits in the present embodiment are the same as the operations illustrated in FIGS. 5A and 5B according to the first embodiment. Here, obviously "the mist collection fan operation at the maintenance" corresponds to the mist collection operation in the above dissolving operation of the deposits.

As described above, even in a case of using the platen suction fan for suctioning and urging the sheet with the platen suction hole as the mist collection fan, the mist collection operation having a small rotating speed is performed for avoiding degradation of print quality at the printing time. Upon controlling the ink deposits to be molten, the mist collection operation having a rotating speed larger than at the printing time is performed. Therefore, it is possible to perform the mist collection operation in high collection efficiency.

(Third Embodiment)

The form of arranging the mist collection mechanism near the maintenance unit in the first embodiment is to increase the collection efficiency of mist that is possibly generated following the preliminary ejection operation in the maintenance unit. In addition, the form of arranging the mist collection mechanism at the under part of the platen in the second embodiment is to increase the collection efficiency is possible to be generated in the dissolving operation of the ink deposits deposited in the platen absorption body. The third embodiment of the present invention relates to the form including both the above forms, that is, the form of arranging mist collection mechanisms in both of the vicinity of the maintenance unit and the under part of the platen.

The configuration of each of the mist collection mechanisms is the same as the configuration explained in each of the first and the second embodiments. In addition, an operation of each of the mist collection mechanisms during printing operation is the same as the operation described above in FIG. 5A.

Figure 7:
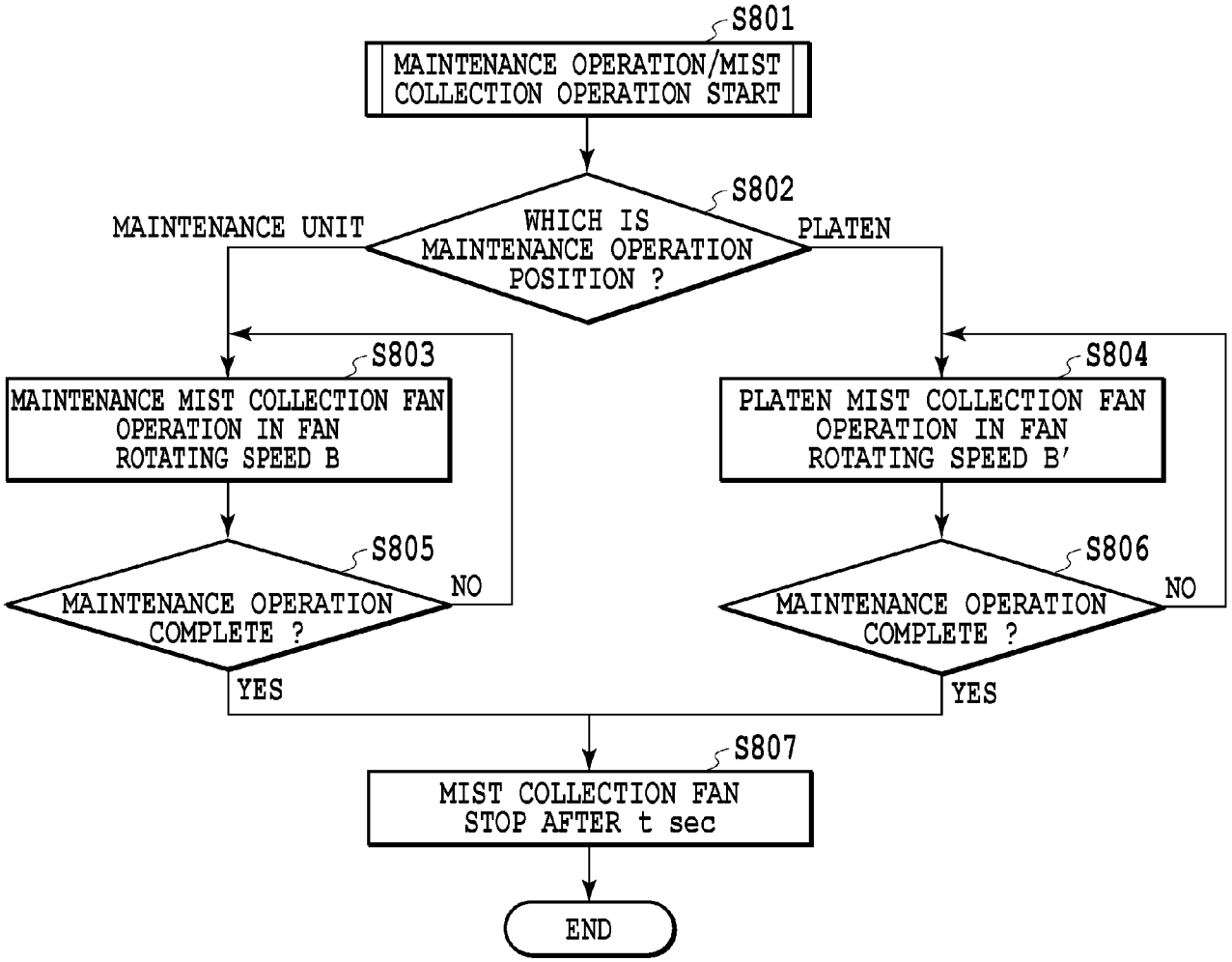
FIG. 7 is a flow chart illustrating a mist collection operation at the maintenance according to a third embodiment of the present invention.

FIG. 7 is a flow chart illustrating a mist collection operation at the maintenance operation according to the third embodiment. In the following explanation, for descriptive purposes, the mist collection mechanism in the vicinity of the maintenance unit is called a maintenance mist collection mechanism, and the mist collection mechanism communicated with the platen suction hole is called a platen mist collection mechanism.

In FIG. 7, at step 801 the maintenance operation accompanied by the ink ejection from the print head is started, and the mist collection operation is started. In this mist collection operation, first at step 802 it is determined which one of a maintenance operation to be performed in the maintenance unit and a maintenance operation to be performed in the platen the maintenance operation corresponds to. When the maintenance operation to be performed is performed in the maintenance unit, the process goes to step 803, wherein the maintenance mist collection mechanism is operated and the fan 405 is rotated in the rotating speed B to perform the mist collection operation. On the other hand, when the maintenance operation to be performed is a dissolving operation of ink deposits deposited in the absorption body of the platen, the process goes to step 804, wherein the platen mist collection mechanism is operated and the fan 405 is rotated in the rotating speed B' to perform the mist collection operation. The rotating speeds B and B' set herein each are a rotating speed that is larger than a fan rotating speed during the printing operation and is high in collection efficiency.

Next, when at step 805 or step 806 it is determined that the maintenance operation is completed, at step 807 the fan is stopped after t seconds preliminarily set as a time in which the mist in the apparatus are reduced to be sufficiently small to finish the mist collection operation.

As described above, the mist collection operation in which the rotating speed of the fan is small is performed for avoidance of the degradation of the print quality at the printing time, and the mist collection fan suitable for the maintenance position is selected at the maintenance accompanied by the ink ejection operation to perform the mist collection operation in which the rotating speed of the fan is larger than at the printing time. Therefore it is possible to perform the mist collection operation high in collection efficiency. It should be noted that in the above example, the mist collection fan is used in one of the mist collection mechanism that is suitable for performing the maintenance and is in the vicinity of the maintenance unit or the mist collection mechanism under the platen, but may be used in both of them.

(Fourth Embodiment)

Figure 8:
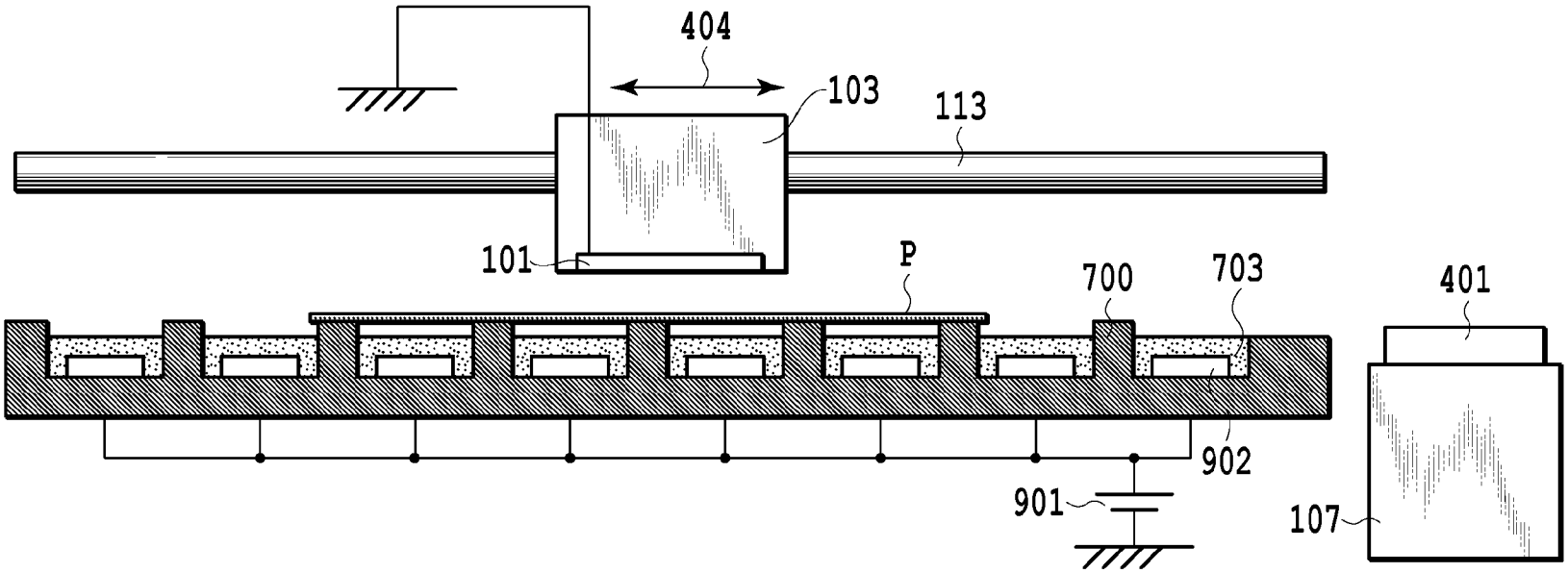
FIG. 8 is diagram illustrating an inkjet printing apparatus using an electrostatic mist collection mechanism according to a fourth embodiment of the present invention.

A fourth embodiment of the present invention relates to the form of performing the mist collection by an electrostatic mist collection mechanism. FIG. 8 is diagram illustrating an inkjet printing apparatus using the electrostatic mist collection mechanism according to the fourth embodiment. In FIG. 8, components identical to those illustrated in FIG. 4, FIG. 6 and the like according to each of the aforementioned embodiments are referred to as identical reference signs and the explanation is omitted.

In FIG. 8, a power source 901 generates a potential difference between electrodes 902 provided in the bottom parts of the platen absorption bodies and nozzle surfaces of the print head 101 that are grounded. When a voltage applied to the electrode 902 during the printing operation is indicated at Va, and a voltage applied at the maintenance operation time accompanied by the ink ejection is indicated at Vb, there is a relation of Vb>Va. Platen absorption bodies 703 are made up of absorption members having conductivity and are conductive electrically to the electrodes 902 to generate an electric field between the plate absorption bodies 703 and the print head 101. On the other hand, ink mist generated following the ink ejection from the print head 101 is polarized with electrostatic induction generated by the above electric field. As a result, the polarized ink mist results in having electrical charge opposing the electrical charge applied to the plate absorption bodies 703. This electrostatic induction produces a coulomb force (an electrostatic force) between the platen absorption body and the ink mist to induce the ink mist to the platen absorption body for adherence and collection.

Here, as the voltage to be applied is higher, the collection efficiency is higher, but the amount of the polarized ink mist that adheres to the backside of the sheet P becomes large as well. In view of this respect, the voltage Va to be applied to the electrode 902 during the printing operation is set to a voltage in which the adherence amount of the mist to the backside of the sheet P is allowable. On the other hand, in a case of performing the ink ejection to the platen with an operation of dissolving deposits, the voltage Vb higher in collection efficiency of ink mist is set.

Figure 9A:
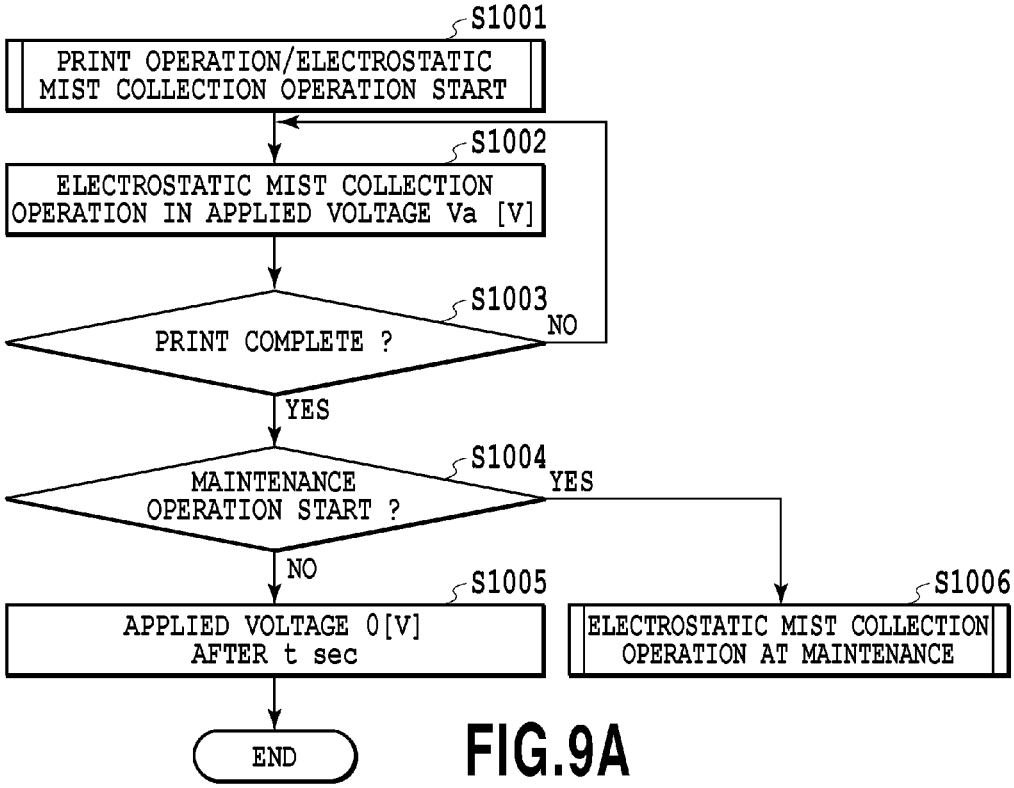
FIGS. 9A and 9B are flow charts each illustrating a mist collection operation according to the fourth embodiment.

FIG. 9A is a flow chart illustrating the mist collection operation. At step 1001, the print operation is started, and the electrostatic mist collection operation is started. In this electrostatic mist collection operation, at step 1002 the electrode voltage Va is applied to cause a mist collection-possible electric field between the print head and the platen. The applied voltage Va at this time is a voltage to the extent that mist that is possibly generated with the ink ejection does not reach the backside of the sheet to adhere thereto. Therefore the electrostatic mist collection operation can prevent the contamination of the sheet. The voltage Va is regularly applied to the electrode during the printing operation, and when at step 1003 it is determined that the printing operation is completed, the process goes to step 1004. In a case where the print operation continues to be performed, the electrostatic mist collection operation at step 1002 continues to be performed. At step 1004 it is determined whether or not the maintenance operation following the print completion is performed. When it is determined that the maintenance operation is not performed, the applied voltage to the electrode is set to 0 V after t seconds to finish the electrostatic mist collection operation. It should be noted that the time t seconds to the electrostatic mist collection operation stop is preliminarily set as a time in which the mist in the ink printing apparatus is reduced to be sufficiently small. When at step 1004 it is determined that the maintenance operation following the printing completion is performed, the electrostatic mist collection operation at the maintenance which will be described later in FIG. 9B, is performed.

Figure 9B:
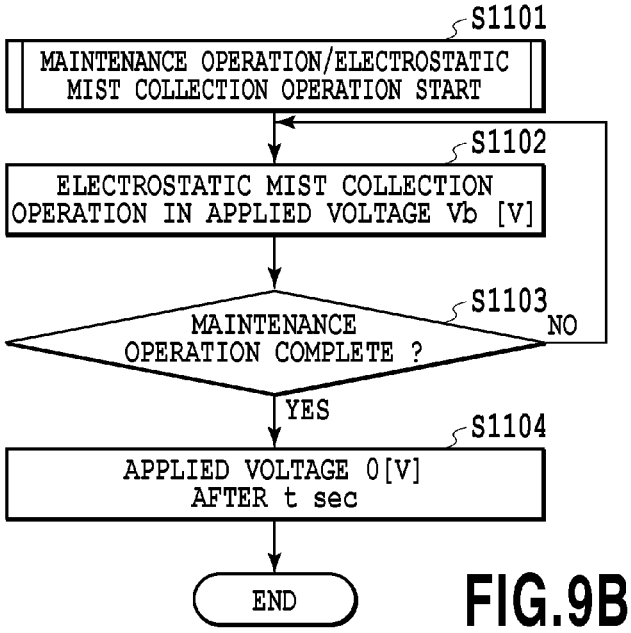

FIG. 9B is a flow chart illustrating the electrostatic mist collection operation at the maintenance operation. At step 1101, the maintenance operation is started, and the electrostatic mist collection operation is started. In this electrostatic mist collection operation, first at step 1102 a voltage of the voltage value Vb is applied to the electrode 902 to collect mist, which is possibly generated with the ink ejection for dissolving deposits, by electrostatic adsorption. The voltage Vb at this time is a value higher than the voltage Va applied during the printing operation as described above. That is, the mist collection operation at the maintenance operation has no problem of contamination on the backside of the sheet because of the lack of presence of the sheet, and therefore the applied voltage Vb can be a value higher than the applied voltage Va during the printing operation. As a result, it is possible to perform the more efficient mist collection at the maintenance by intensifying the electrostatic adsorption furthermore.

At step 1103 it is determined whether or not the maintenance operation is completed. When it is determined that the maintenance operation is not completed, the mist collection operation at step 1102 continues to be performed. When it is determined that the maintenance operation is completed, at step 1104 after t seconds preliminarily set as a time in which the mist in the printing apparatus are reduced to be sufficiently small, the applied voltage is set to 0 V to finish the mist collection operation.

It should be noted that in the above example, the explanation is made of the example of the mist collection operation following the ink ejection for the dissolving operation of dissolving the deposits on the platen absorption body as the maintenance operation, but the maintenance operation is not limited thereto. Also in the maintenance operation of performing the preliminary ejection to the maintenance unit 107, the similar mist collection operation (the applied voltage is a value higher than the applied voltage Va in the middle of printing) is performed.

In addition, the mist collection operation is started at the same time with the print operation and maintenance operation, but even if the mist collection operation is performed ahead of them, the similar effect can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-031662, filed Feb. 20, 2015, which is hereby incorporated by reference wherein in its entirety.

What is claimed is:

1. A printing apparatus performing a printing operation to form an image on a sheet, comprising:

a print head configured to eject ink;

a platen configured to hold the sheet, wherein the platen has an ink absorption element that absorbs ink ejected outside of the sheet while performing a margin-less printing operation;

a collection unit configured to collect ink mist generated from the print head while the print head ejects ink; and a control unit configured to control the collection unit to increase a collection power in a maintenance operation to be greater than in the margin-less printing operation, wherein the maintenance operation is a dissolving operation different from the margin-less printing operation, in which the print head ejects ink onto the ink absorption element to dissolve deposited ink that was ejected and deposited on the ink absorption element in the margin-less printing operation.

2. The printing apparatus according to claim 1, wherein the collection unit suctions the ink mist by a negative pressure for collection of the ink mist.

3. The printing apparatus according to claim 2, wherein the platen holds the sheet by the negative pressure generated by the collection unit.

4. The printing apparatus according to claim 1, wherein the collection unit collects the ink mist by an electrostatic force.

5. The printing apparatus according to claim 1, wherein a plurality of collection units are provided and at least one of the plurality of collection units is selected according to a position of the print head.

6. The printing apparatus according to claim 1, further comprising a carriage mounting the printing head, wherein the dissolving operation is performed while the carriage moves over the absorption element.

* * * * *